US005126947A

United States Patent [19]

Koyama

[11] Patent Number: 5,126,947

[45] Date of Patent: Jun. 30, 1992

[54] METHOD OF CONTROLLING PLATE FLATNESS AND DEVICE THEREFOR

[75] Inventor: Toshihiro Koyama, Miyoshi, Japan

[73] Assignee: Kabushiki Kaisha Toshiba, Kawasaki, Japan

[21] Appl. No.: 453,286

[22] Filed: Dec. 22, 1989

[30] Foreign Application Priority Data

Dec. 22, 1988 [JP] Japan ..... 63-324441

[51] Int. Cl.[5] ..... B29F 3/00; D21F 1/00; G06F 15/46

[52] U.S. Cl. ..... 364/469; 425/141; 364/471; 364/473

[58] Field of Search ..... 364/468, 469, 471, 473, 364/563; 425/135, 140-145; 162/252, 263, 262; 264/40.1, 40.7

[56] References Cited

U.S. PATENT DOCUMENTS

| | | | |
|---|---|---|---|
| 3,626,165 | 12/1971 | McCall | 364/473 |
| 3,914,585 | 10/1975 | Wilhelm, Jr. et al. | 364/471 |
| 3,936,665 | 2/1976 | Donoghue | 364/469 |
| 4,514,812 | 4/1985 | Miller et al. | 364/473 |
| 4,707,779 | 11/1987 | Hu | 364/469 |
| 4,858,139 | 8/1989 | Wirtz | 364/473 |
| 4,882,104 | 11/1989 | Dobrowsky | 364/473 |
| 4,903,528 | 2/1990 | Balakrishnan et al. | 364/473 |
| 4,931,982 | 6/1990 | Hayashida | 364/469 |

FOREIGN PATENT DOCUMENTS 59-218206 12/1984 Japan .

*Primary Examiner*—Joseph Ruggiero
*Assistant Examiner*—Jim Trammell
*Attorney, Agent, or Firm*—Foley & Lardner

[57] ABSTRACT

An improved plate flatness control method adapted to effect a control so that plate flatness of a rolled material is made optimum by adjusting manipulated variables. In determining correction quantities of the manipulated variables, under the constraint that upper and lower limits exist in at least one of the manipulated variables and the correction quantities, a weighted square sum of deviations of a plate flatness distribution in the width direction of the rolled material is taken as an objective function to determine, using a non-linear programming, correction quantities of the manipulated variables where the objective function becomes minimum, thus, to control the plate flatness of the rolled material on the basis of the determined correction quantities of the manipulated variables.

2 Claims, 2 Drawing Sheets

METHOD OF CONTROLLING PLATE FLATNESS AND DEVICE THEREFOR

BACKGROUND OF THE INVENTION

This invention relates to a method of controlling plate flatness of a rolled material.

Heretofore, in the plate rolling field, there has been proposed a control to use a plurality of manipulated variables at the same time, thus to utilize the characteristics of respective manipulated variables at their maximum in order to cope with a control for various patterns damaging the plate flatness such as edge wave, center buckle, quarter buckle or complex buckle. As a representative example thereof, there has been proposed, as shown in the Japanese Patent Application No. 153165/80, a plate flatness feedback control in which the working roll bending and the intermediate roll bending are used at the same time, thus taking into consideration the degree of influence or effect on the plate flatness of the respective roll bending actions.

However, as a matter of course, the operating ranges of respective manipulated variables of the working roll bending or the intermediate roll bending, etc. have upper and lower limits. Thus, only operation in a limited range is permitted. Further, in the case where the operating speed is extremely slow, as for roll shift, as compared to that for roll bending, correction quantities of the variables are also limited. Accordingly, since consideration is not sufficiently taken for the above limits in the conventional method, a control, such that the characteristics of respective manipulated variables are sufficiently exhibited, does not result.

In addition, as disclosed in PCT/JP81/00285, there is proposed a method of approximating a buckle rate signal divided in a width direction by a higher-order polynominal with respect to the width direction, developing the polynominal into an orthogonal function series, thus to determine manipulated variables by utilizing the fact that the influences of coefficients of respective function series and manipulated variables of the actuator subject to control have a correspondence relationship therebetween sufficient to control. However, satisfactory control cannot be obtained even by this method.

SUMMARY OF THE INVENTION

Accordingly, an object of this invention is to provide flatness control method and a plate apparatus, such that the characteristics of respective manipulated variables are exhibited to their maximum.

In accordance with the present invention, there is provided a plate flatness control method adapted to effect control so that plate flatness of a rolled material is made optimum by adjusting manipulated variables, wherein, in determining correction quantities of the manipulated variables, under the constraint that upper and lower limits exist in at least one of the manipulated variables and one of the correction quantities, a weighted square sum of deviations of a plate flatness distribution in a width direction of said rolled material is taken as an objective function to determine, using non-linear programming, correction quantities of the manipulated variables where the objective function becomes minimum, to thus control the plate flatness of the rolled material on the basis of the determined correction quantities of the manipulated variables.

There is also provided a plate flatness control method comprising the steps of: taking out desired value data of a flatness distribution in a width direction from a storage unit therefor; determining a current flatness distribution by means of a flatness meter; describing an objective function using the current flatness distribution and the desired value data of flatness distribution in the width direction; taking out upper and lower data of manipulated variables, limit data relating to correction quantities of the manipulated variables, and influence coefficient data of the manipulated variables from respective storage units; describing an inequality constraint from upper and lower data of the manipulated variables and limit data relating to the correction quantities of the manipulated variables; describing an equality constraint from the influence coefficient data of said manipulated variables; solving the objective function under the inequality constraint and the equality constraint to provide correction quantities of the manipulated variables; and delivering the correction quantities thus provided to a device for correcting said manipulated variables.

In order to conduct the method, there is provided. A flatness control apparatus comprising a first storage unit for storing desired value data of a flatness distribution in the width direction; second to fourth storage units for storing upper and lower data of manipulated variables, limit data relating to correction quantities of the manipulated variables, and influence coefficient data of the manipulated variables, respectively; a flatness meter for determining a current flatness distribution; an objective function describing unit for describing an objective function using the current flatness distribution and the desired value data of the distribution in the width direction; an inequality constraint describing unit for describing an inequality constraint from the upper and lower limit data of the manipulated variables and the limit data relating to the correction quantities of the manipulated variables; an equality constraint describing unit for describing an equality constraint from the influence coefficient data of the manipulated variables; a computation unit for solving the objective function under the inequality constraint and the equality constraint to determine correction quantities of the manipulated variables; and a correction device for correcting the manipulated variables by the determined correction quantities.

In accordance with the plate flatness control method according to this invention, under the restrictive condition where there exists a restriction in at least one of the manipulated variables and the correction quantities, correction quantities of manipulated variables such that an objective function which is the weighted square sum of deviations of a plate flatness distribution in a width direction of a rolled material is minimized are determined by using a non-linear programing. The plate flatness of a rolled material is controlled on the basis of the determined correction quantities of manipulated variables. As a result, the characteristics of manipulated variables are exhibited at their maximum. Thus, optimum plate flatness control is conducted.

Namely, in accordance with this invention, in determining correction quantities of manipulated variables for minimizing deviations from a desired value of the plate flatness at respective control timings, an approach is employed to satisfy the restriction of the upper and lower limit values and the correction quantities which is imposed on the manipulated variables, to thereafter determine a set of correction quantities of optimum manipulated variables. Accordingly, even in the case where any manipulated value reaches the above-described various limit values, there is no possibility that controllability is lost, thus making it possible to realize plate flatness control which exhibits the characteristics at their maximum.

DESCRIPTION OF THE PREFERRED EMBODIMENT

Figure 1:
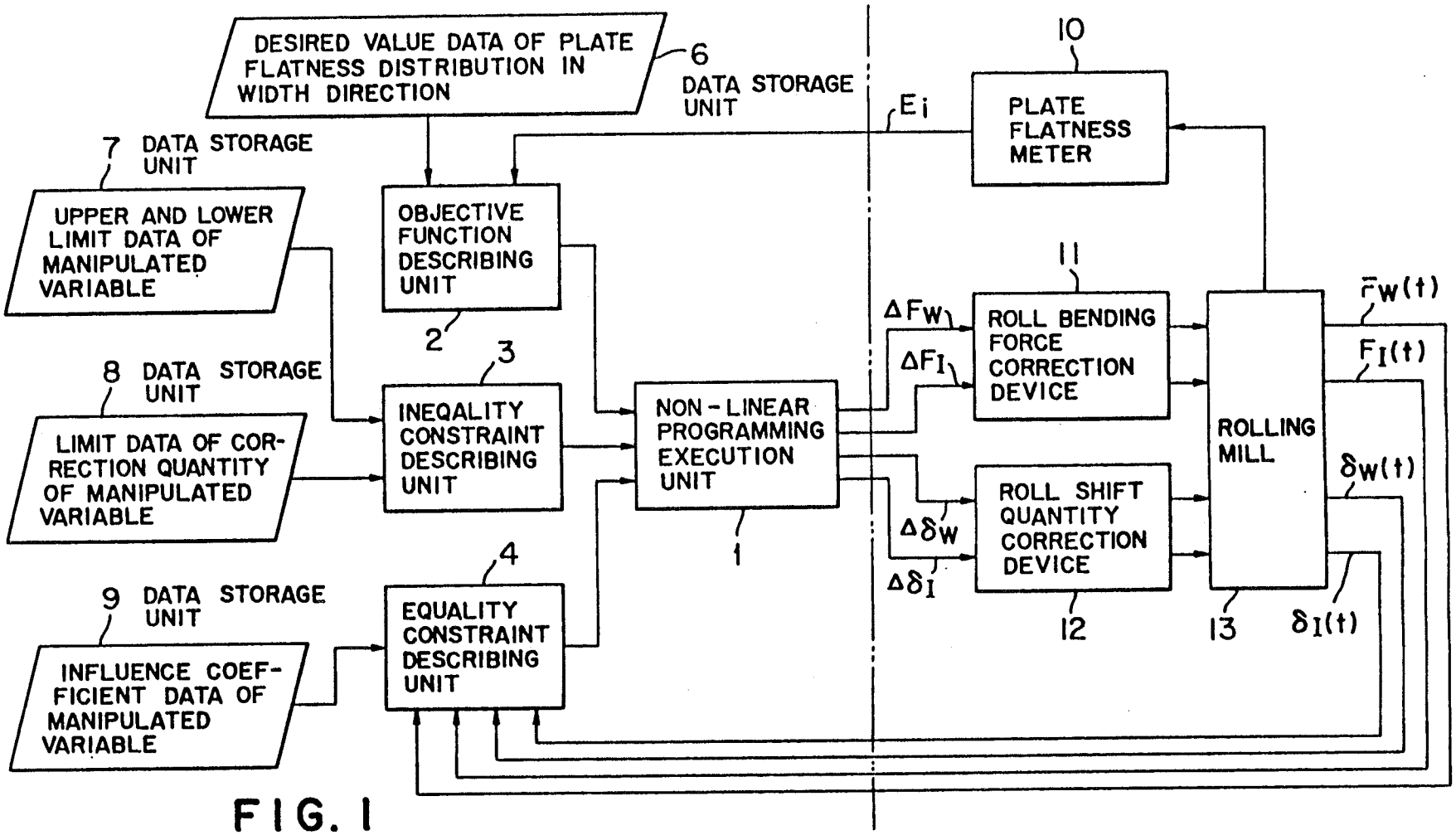
FIG. 1 is a block diagram showing an arrangement of an apparatus according to this invention.

An embodiment of an apparatus for carrying out a plate flatness control method according to this invention is shown in FIG. 1. This apparatus includes a non-linear programming execution unit 1, an objective function describing unit 2, an inequality constraint describing unit 3, an equality constraint describing unit 4, data storage units 6, 7, 8, 9, a plate flatness meter 10, a roll bending force correction unit 11, and a roll shift quantity correction unit 12.

The object of the plate flatness control is to allow a distribution in a width direction of the plate flatness, i.e., concave and convex using an average level of buckle as a reference to become as close a target or desired distribution as possible. Accordingly, an objective function expressed by the following equation (1) is stored in the objective function describing unit 2.

$$J = \sum_{i=1}^{N} r_i\{E(Z_i,t) + \Delta E(Z_i,t + \Delta t)\}^2 \quad (1)$$

In the above equation (1),

J: an objective function to be minimized;

N: the number of plate flatness evaluation positions (in a width direction), $r_i$: a weight coefficient;

$Z_i$: a coordinate in a plate width direction, t: a time;

$E(Z_i,t)$: a result value of a distribution in a width direction of a plate flatness deviation (difference with respect to a flatness desired value); and $\Delta E(Z_i, t+\Delta t)$: a predicted value of a corrected quantity of the distribution in a width direction of a plate flatness deviation between t and $t+\Delta t$. For example, when a working roll bending force $F_w$, an intermediate roll bending force $F_I$, a working roll shift quantity $\delta_w$, and an intermediate roll shift quantity $\delta_I$ are assumed to be given as the manipulated variables, the above-mentioned predicted value of correction quantity of distribution in a width direction is expressed as follows:

$$\Delta E(Z_i, t+\Delta t) = (\partial E_i/\partial F_w)\cdot\Delta F_w + (E_i/\partial F_I)\cdot\Delta F_I + (\partial E_i/\partial \delta_w)\cdot\Delta\delta_w + (\partial E_i/\partial \delta_I)\cdot\Delta\delta_I \quad (2)$$

In the above equation (2), $\Delta F_w$: a working roll bending force correction quantity;

$\Delta F_I$: an intermediate roll bending force correction quantity;

$\Delta\delta_w$: a working roll shift correction quantity;

$\Delta\delta_I$: an intermediate roll shift correction quantity;

$(\partial E_i/\partial F_w)$: an influence coefficient of a working roll bending force with respect to plate flatness $E_i$ at a coordinate $Z_i$ in a width direction of the plate;

$(\partial E_i/\partial F_I)$: an influence coefficient of an intermediate roll bending force with respect to a plate flatness $E_i$ at a coordinate $Z_i$ in a width direction of the plate;

$(\partial E_i/\partial \delta_w)$: an influence coefficient of a working roll shift quantity with respect to a plate flatness $E_i$ at a coordinate $Z_i$ in a width direction of the plate; and $(\partial E_i/\partial \delta_I)$ an influence coefficient of an intermediate roll shift quantity with respect to a plate flatness $E_i$ at a coordinate $Z_i$ in a width direction of the plate.

In the above equation (2), the above-described influence coefficient, e.g., $(\partial E_i/\partial F_w)$ is a change quantity of the plate flatness $E_i$ at a coordinate $Z_i$ in a width direction of the plate when the working roll bending force $F_w$ is changed by a unit quantity. This influence coefficient is actually measured in advance, or determined by simulation, and is stored in the data storage unit 9. Furthermore, since the target plate flatness distribution is constant, the influence coefficient, e.g., $(\partial E_i/\partial F_w)$ becomes equal to the same value as the partial differential coefficient $(\partial E/\partial F_w)_{z=zi}$ relating to the working roll bending force $F_w$ of the plate flatness deviation at the position of $Z_i$. In this embodiment, the desired value data of the distribution in a width direction of the plate flatness necessary for determining the result value $(Z_i, t)$ of the distribution in a width direction of a plate flatness deviation necessary for determining the objective function J is stored in the data storage unit 6. The result value $E_i$ of the distribution in the width direction of the plate flatness is given as an output from the plate flatness meter 10.

In the inequality constraint describing unit 3, the inequality constraint relating to the upper and lower limits of manipulated variables and the upper and lower limits of correction quantities of manipulated variables is described. Furthermore, the relationship (described later) between present values $F_w(t)$, $F_I(t)$, $\delta_w(t)$, $\delta_I(t)$ and manipulated variables and corrected manipulated variables is described in the equality constraint describing unit 4. As the numeric data relating to the inequality constraint, manipulated variable upper and lower data are stored in the data storage unit 7, and correction quantity limit data of manipulated variables are stored in the data storage unit 8. These data storage units may be provided separately from each other, or constructed as respective sections of a single storage unit.

The non-linear programming execution unit 1 serves to determine a solution (correction quantities of manipulated variables) for minimizing the objective function J described in the objective function describing unit 2 by using the non-linear programming under various constraints described in the inequality constraint describing unit 3 and the equality constraint describing unit 4. A set of $\Delta F_w$, $\Delta F_I$, $\Delta\delta_w$, $\Delta\delta_I$ of correction quantities of optimum manipulated variables determined in the non-linear programming execution unit 1 are applied to the rolling mill 13 through the roll bending force correction device 11 and the roll shift quantity correction device 12. The control of the plate flatness is therefore carried out.

The operation of the embodiment will now be described. It is to be noted that since the key point of this invention does not reside in providing a proposed non-linear programming technique in itself, but resides in providing a proposed method for realizing a plate flatness control using a well known non-linear programming technique, the detailed description of the algorithm of the non-linear programming itself is omitted herein (for a detailed description relating to the algorithm of the non-linear programming, see, e.g., "Non-linear programming" pp. 251 and 252, published by Kabushiki Kaisha Nikka Giren Company).

Since the object of the plate flatness control is to bring the distribution in a width direction of the plate flatness as near as possible to a target value, the control index minimizes the above-described equation (1).

In equation (1), $r_i$ represents a coefficient for weighting plate flatness deviations at respective positions in a width direction of the plate. All coefficients may be set to 1, to thus equally weight respective deviations, or a plate flatness deviation at a specific position may be particularly weighted. A result value $E(z_i, t)$ of the distribution in a width direction of a plate flatness deviation at time $t_1$ is obtained by subtracting the desired value data of a distribution in a width direction of the plate flatness stored in the data storage unit 6 from the result value $E_i$ of the distribution in a width direction of the plate flatness which is an output from the plate flatness meter 10. The predicted value $E(z_i, t+\Delta t)$ of correction quantity in a width direction of the plate flatness between t and $t+\Delta t$ is given by the above-described equation (2).

$(\partial E_i/\partial F_w)$ $(i=1-N)$ $(\partial E_i/\partial F_I)$ $(i=1-N)$ $(\partial E_i/\partial \delta_w)$ $(i=1-N)$ $(\partial E_i/\partial \delta_I)$ $(i=1-N)$ are stored as manipulated variable influence coefficient data in the data storage unit 9. Furthermore, the relationships between the present values $F_w(t)$, $F_I(t)$, $\delta_w(t)$ $\delta_I(t)$ of the manipulated variables and corrected manipulated variables $F_w(t+\Delta t)$, $F_I(t+\Delta t)$, $\delta_w(t+\Delta t)$, $\delta_I(t+\Delta t)$ are expressed as follows:

$$F_w(t+\Delta t)=F_w(t)+\Delta F_w \quad (3)$$

$$F_I(t+\Delta t)=F_I(t)+\Delta F_I \quad (4)$$

ti $$\delta_w(t+\Delta t)=\delta_w(t)+\Delta\delta_w \quad (5)$$

$$\delta_I(t+\Delta t)=\delta_I(t)+\Delta\delta_I \quad (6)$$

At this time, for the corrected manipulated variables $F_w(t+\Delta t)$, $F_I(t+\Delta t)$, $\delta_w(t+\Delta t)$, $\delta_I(t+\Delta t)$, there exist the upper and lower constraints (mechanical constraint of the rolling mill as indicated by the following equations.

$F_w(t+\Delta t) \leqq F_{WMAX}$: Working roll bending force upper limit (7)

$F_w(t+\Delta t) \geqq F_{WMIN}$: Working roll bending force lower limit (8)

$F_I(t+\Delta t) \leqq F_{IMAX}$: Intermediate roll bending force upper limit (9)

$F_I(t+\Delta t) \geqq F_{IMIN}$: Intermediate roll bending force lower limit (10)

$\delta_w(t+\Delta t) \leqq \delta_{WMAX}$: Working roll shift quantity upper limit (11)

$\delta_w(t+\Delta t) \geqq \delta_{WMIN}$: Working roll shift quantity lower limit (12)

$\delta_I(t+\Delta t) \leqq \delta_{IMAX}$: Intermediate roll shift quantity upper limit (13)

$\delta(t\ 30\ \Delta t) \geqq_{IMIN}$: Intermediate roll shift quantity lower limit (14)

The upper and lower limits of respective manipulated variables $F_{WMAX}$, $F_{WMIN}$, $F_{IMAX}$, $F_{IMIN}$, $\delta_{WMAX}$, $\delta_{WMIN}$, $\delta_{WMAX}$ and $\delta_{WMIN}$ are stored as manipulated variable upper and lower limit data in the data storage unit 7. Furthermore, for the respective manipulated variables, there is a limitation to the corrective quantities. Accordingly, correction quantity (i.e., corrected speed quantity) of the manipulated variable between control sampling pitches is limited as indicated by the following equations.

$|\Delta F_w| \leqq \Delta F_{WMAX}$: Limit of a correction quantity of the working roll bending force between control sampling pitches (15)

$|\Delta F_I| \leqq \Delta F_{IMAX}$: Limit of a correction quantity of the intermediate roll bending force between control sampling pitches (16)

$|\Delta\delta_w| \leqq \delta_{WMAX}$: Limit of a correction quantity of the working roll shift quantity between control sampling pitches (17)

$|\Delta\delta_I| \leqq \Delta\delta_{IMAX}$: Limit of a correction quantity of the intermediate roll shift quantity between control sampling pitches (18)

The limit parameters $\Delta F_{WMAX}$, $\Delta F_{IMAX}$, $\Delta\delta_{WMAX}$, $\Delta\delta_{IMAX}$ in the above-equation are stored as corrected quantity limit data of manipulated variables in the data storage unit 8.

The formulation necessary for executing a non-linear programming on the basis of equations (2) to (18) is as follows. The objective function expressed by the above equation (1) can be used as it is, as the objective function to be stored into the objective function describing unit 2. The conditions indicated by equation (7) to stored in the objective function describing unit 2. The conditions indicated by equations (7) to (18) are taken as the conditions to be stored into the inequality constraint describing unit 3. In the case of using non-linear programming, as is well known, it is required that the right side of the inequality equal zero and the directions of the inequalities all be the same. Accordingly , these equations are rewritten as follows.

$F_w(t+\Delta t)-F_{WMAX} \leqq 0$: Working roll bending force upper limit (19)

$F_{WMIN}-F_w(t+\Delta t) \leqq 0$: Working roll bending force lower limit (20)

$F_I(t+\Delta t)-F_{IMAX} \leqq 0$: Intermediate roll bending force upper limit (21)

$F_{IMIN}-F_I(t+\Delta t) \leqq 0$: Intermediate roll bending force lower limit (22)

$\delta_w(t+\Delta t)-\delta_{WMAX} \leqq 0$: Working roll shift quantity upper limit (23)

$\delta_{WMIN}-\delta_w(t+\Delta t) \leqq 0$: Working roll shift quantity lower limit (24)

$\delta_I(t+\Delta t)-\delta_{IMAX}\leqq 0$: Intermediate roll shift quantity upper limit (25)

$\delta_{IMIN}-\delta_I(t+\Delta t)\leqq 0$: Intermediate roll shift quantity lower limit (26)

$\Delta F_w-\Delta F_{WMAX}\leqq 0$: Working roll bending force correction quantity upper limit between control sampling pitches (27)

$-\Delta F_{WMAX}-\Delta F_w\leqq 0$: Working roll bending force correction quantity lower limit between control sampling pitches (28)

$\Delta F_I-\Delta F_{IMAX}\leqq 0$: Intermediate roll bending force correction quantity upper limit between control sampling pitches (29)

$-\Delta F_{IMAX}-\Delta F_I\leqq 0$: Intermediate roll bending force correction quantity lower limit between control sampling pitches (30)

$\Delta\delta_w-\Delta\delta_{WMAX}\leqq 0$: Working roll shift correction quantity upper limit between control sampling pitches (31)

$-\Delta\delta_{WMAX}-\Delta\delta_w\leqq 0$: Working roll shift correction quantity lower limit between control sampling pitches (32)

$\Delta\delta_I-\Delta\delta_{IMAX}\leqq 0$: Intermediate roll shift correction quantity upper limit between control sampling pitches (33)

$-\Delta\delta_{IMAX}-\Delta\delta_I\leqq 0$: Intermediate roll shift correction quantity lower limit between control sampling pitches (34)

Above-mentioned equations (19) to (34) provide the conditions stored in the inequality constraint describing unit 3, shown in FIG. 1.

Furthermore, the above-mentioned equations (2) to (6) are taken as the conditions to be stored into the equal constraint describing unit 4.

By the above analysis, the problem of solving plate flatness control using non-linear programming is formulated into "problem to determine a set of $\Delta F_w$, $\Delta F_I$, $\Delta\delta_w$, $\Delta\delta_I$ of correction quantities of optimum manipulated variables to minimize the objective function (1) under the inequality constraints (19) to (34) and the equality constraints (2) to (6)". In the non-linear programming execution unit 1, a set of $\Delta F_w$, $\Delta F_I$, $\Delta\delta_w$, $\Delta\delta_I$ correction quantities of optimum manipulated variables are determined by computing the solution of the above problem. In performing an actual computation, the non-linear programming execution unit 1 further applies the following translation to the above-mentioned problem in order that is take a form permitting that problem to be solved using a well known algorithm.

First, substitution of equation (2) into equation (1) gives:

$$J=\sum_{i=1}^{N} r_i\{E(z_i,t)+(\partial E_i/\partial F_w)\cdot \Delta F_w+(\partial E_i/\partial F_I)\cdot \Delta/F_I+(\partial E_i/\partial\delta_w)\cdot\Delta\delta_w+(\partial E_i/\partial\delta_I)\cdot\Delta\delta_I\}^2 \quad (35)$$

Furthermore, substitution of equations (3) to (6) into equations (19) to (34) gives:

$$F_w(t)+\Delta F_w-F_{WMAX}\leqq 0 \quad (36)$$

$$F_{WMIN}-F_w(t)-\Delta F_w\leqq 0 \quad (37)$$

$$F_I(t)+\Delta F_I-F_{IMAX}\leqq 0 \quad (38)$$

$$F_{IMIN}-F_I(t)-\Delta F_I\leqq 0 \quad (39)$$

$$\delta_w(t)+\Delta\delta_w-\delta_{WMAX}\leqq 0 \quad (40)$$

$$\delta_{WMIN}-\delta_w(t)-\Delta\delta_w\leqq 0 \quad (41)$$

$$\delta_I(t)+\Delta\delta_w-\delta_{IMAX}\leqq 0 \quad (42)$$

$$\delta_{IMIN}-\delta_I(t)-\Delta\delta_I\leqq 0 \quad (43)$$

$$\Delta F_w-\Delta F_{WMAX}\leqq 0 \quad (44)$$

$$-\Delta F_{WMAX}-\Delta F_w\leqq 0 \quad (45)$$

$$\Delta F_I-\Delta F_{IMAX}\leqq 0 \quad (46)$$

$$-\Delta F_{IMAX}-\Delta F_I\leqq 0 \quad (47)$$

$$\Delta\delta_w-\Delta\delta_{WMAX}\leqq 0 \quad (48)$$

$$\Delta\delta_{WMAX}-\Delta\delta_w\leqq 0 \quad (49)$$

$$\Delta\delta_I-\Delta\delta_{IMAX}\leqq 0 \quad (50)$$

$$-\Delta\delta_{IMAX}-\Delta\delta_I\leqq 0 \quad (51)$$

By the formulation of the above-mentioned equations (35) to (51), the plate flatness control problem results in the problem "to determine a set of $\Delta F_w$, $\Delta F_I$, $\Delta\delta_w$, $\Delta\delta_I$ of correction quantities of optimum manipulated variables to minimize the objective function expressed as the equation (35) under the inequality constraints equations (36) to (51)". Accordingly, the non-linear programming unit 1 computes combinations $\Delta F_w$, $\Delta F_I$, $\Delta\delta_w$, $\Delta\delta_I$ of correction quantities of optimum manipulated variables using a well known algorithm, e.g., a multiplier method, etc. In accordance with this set, the correction of the plate flatness manipulated variables of the rolling mill 13 is made through the roll bending force correction device 11 and the roll shift quantity correction device 12. Plate flatness is, therefore, controlled to equal a desired value.

Figure 2:
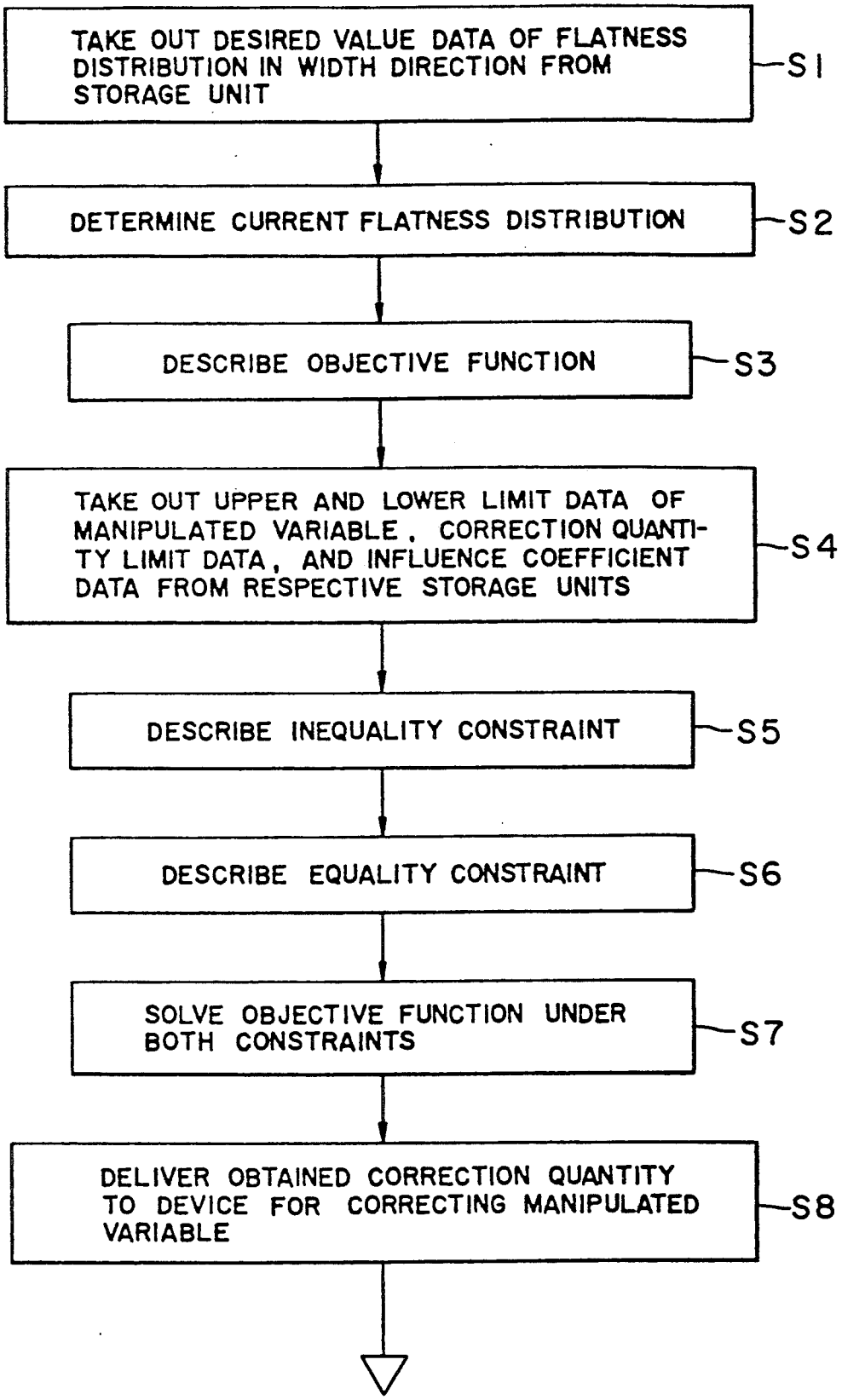
FIG. 2 is a flowchart showing a method according to this invention.

In short, the plate flatness control method comprises, as shown in FIG. 2, the steps of taking out upper and lower limit data of manipulated variables, limit data relating to correction quantities of the manipulated variables, and influence coefficient data of the manipulated variables from respective storage units therefor (step S4), determining a flatness distribution using the flatness meter (step S2), taking out desired value data of a distribution in a width direction of flatness from the storage unit therefor (step S1), describing an objective function using a present flatness distribution and desired value data of the distribution in the width direction of the flatness (step S3), describing in equality constraint from limit data relating to the upper and lower limit data of the manipulated quantity and correction quantities of the manipulated variables (step S5), describing an equality constrain from the influence coefficient data of the manipulated variables (step S6), solving the objective function under the inequality constraint and the equality constraint to provide correction quantities of the manipulated variables (step S7), and delivering the correction quantities to a device for correcting the manipulated variable (step S8).

It is to be noted that steps up to steps S1 to S6 are carried out substantially at the same time, but are not necessarily carried out in accordance with their step sequence.

In this embodiment, in determining correction quantities of manipulated variables in respective control timings, an approach is employed to determine a combination of correction quantities of an optimum manipulated variables under the state where the upper and lower limits of respective manipulated variables and the upper and lower limits of respective correction quantities are taken into account. Thus, even in the case where any manipulated variable reaches the above-described upper or lower limit, it is possible to realize a plate flatness control in which the characteristic of each manipulated quantity is exhibited to its maximum.

In this embodiment, the working roll bending force, the intermediate roll bending force, the working roll shift quantity, and the intermediate roll shift quantity are taken as respective manipulated quantities. However, from a practical point of view, a part of these manipulated variables may be taken as the target manipulated variables, or alteration of manipulated variables may be made so as to include roll leveling and/or roll coolant, etc.

As described above, the key point of this invention does not reside in providing a proposed non-linear programming technique in itself, but resides in providing a proposed method of realizing a plate flatness control using well known non-linear programming. Accordingly, any algorithm (e.g., multiplier method, translation method, etc.) may be used as the non-linear programming.

What is claimed is:

1. A plate flatness control method for a rolling mill having a plurality of flatness correction mechanisms under the constraint that upper and lower limits exist in at least one of manipulated variables and correction quantities, comprising the steps of:

taking out from a first storage unit desired value data of a flatness distribution in a width direction;

detecting current flatness distribution data in a width direction by a flatness meter provided at an exit side of a stage;

describing an objective function by obtaining a weighted square sum of a difference between said desired value data and detected current flatness distribution data and a predicted correction value of the distribution obtained by said flatness correction mechanisms;

taking out upper and lower limit data, rate limit data relating to correction quantities of said manipulated variables, and gradient coefficient data of said manipulated variables from respective storage units;

describing an equality constraint from relations between gradient coefficient data expressed by a flatness variation in response to a unit correction quantity of said correction mechanism and a predicted value of a corrected quantity of a flatness deviation distribution expressed by manipulated variables of said flatness correction mechanism, and from relations between present values and corrected values of the manipulated variables of each flatness correction mechanism;

describing an inequality constraint from constraints relating to upper and lower limits of manipulated variables of said flatness correction mechanisms;

finding the combination of corrected manipulated variables of said flatness correction mechanism which satisfy said equality constraint and inequality constraints and which make a value for said objective function minimum using non-linear programming technique; and controlling a plate flatness by manipulating said plate flatness correction mechanisms using said corrected manipulated variables.

2. A plate flatness control apparatus for a rolling mill having a plurality of flatness correction mechanisms under the constraint that upper and lower limits exist in at least one of manipulated variables and correction quantities, comprising:

first storage means for storing desired value data of a flatness distribution;

second to fourth storage means for storing upper and lower limit data of manipulated variables, rate limit data relating to correction quantities of said manipulated variables, and gradient coefficient data of said manipulated variables, respectively;

flatness detecting means for detecting a current flatness distribution;

objective function describing means for describing an objective function by obtaining a weighted square sum of a difference between said desired value data derived from said first stage means and detected current flatness distribution data and a predicted correction value of the distribution obtained by said flatness correction mechanisms;

equality constraint describing means for describing an equality constraint from relations between gradient coefficient data expressed by flatness variation in response to a unit correction quantity of said correction mechanism and a predicted value of a corrected quantity of a flatness deviation distribution expressed by manipulated variables of said flatness correction mechanism, and from relations between present values and corrected values of the manipulated variables of each flatness correction mechanism;

inequality constraint describing means for describing an inequality constraint from constraints relating to the upper and lower limits of manipulated variables of said flatness correction mechanism;

means for determining a combination of corrected manipulated variables of said flatness correction mechanism which satisfy said equality constraint and inequality constraint and which makes a value of said objective function minimum using non-linear programming technique; and means for controlling the plate flatness by manipulating said plate flatness correction mechanisms using said corrected manipulated variables.

* * * * *